US010381785B2

(12) United States Patent
Maesoba et al.

(10) Patent No.: US 10,381,785 B2
(45) Date of Patent: Aug. 13, 2019

(54) SHIELD CONNECTOR AND SHIELDED CABLE WITH CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Hiroyoshi Maesoba, Mie (JP); Toshifumi Ichio, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 15/777,792

(22) PCT Filed: Nov. 24, 2016

(86) PCT No.: PCT/JP2016/084801

§ 371 (c)(1),
(2) Date: May 21, 2018

(87) PCT Pub. No.: WO2017/090682

PCT Pub. Date: Jun. 1, 2017

(65) Prior Publication Data

US 2018/0351305 A1 Dec. 6, 2018

(30) Foreign Application Priority Data

Nov. 24, 2015 (JP) ..... 2015-229222

(51) Int. Cl.
*H01R 4/18* (2006.01)
*H01B 11/18* (2006.01)
(Continued)

(52) U.S. Cl.
CPC ..... *H01R 13/6593* (2013.01); *H01B 11/1895* (2013.01); *H01R 4/184* (2013.01); *H01R 13/6581* (2013.01)

(58) Field of Classification Search
CPC ..... H01R 13/506; H01R 13/516; H01R 13/6581; H01R 13/6593; H01R 4/184; H01B 11/1895
See application file for complete search history.

(56) References Cited

U.S. PATENT DOCUMENTS 5,273,459 A * 12/1993 Davis ..... H01R 13/6593 439/607.48
5,820,412 A * 10/1998 Koegel ..... H01R 9/032 439/607.51

(Continued)

FOREIGN PATENT DOCUMENTS

JP 11-149957 6/1999
JP 2009-99300 5/2009

(Continued)

OTHER PUBLICATIONS

International Search Report dated Feb. 28, 2017.

*Primary Examiner* — Edwin A. Leon
*Assistant Examiner* — Oscar C Jimenez
(74) *Attorney, Agent, or Firm* — Gerald E. Hespos; Michael J. Porco; Matthew T. Hespos

(57) ABSTRACT

A shield connector includes an inner housing that hold terminals connected to wires, and a shield shell accommodates an inner housing and an end of the shielded cable. The shield shell includes a cable inserting portion to receive the shielded cable. A convex portion projects from a side of the inner housing. The shield shell includes a base on which the inner housing is arranged, and a cover fit to the base. The base includes a bottom plate to cover a bottom of the inner housing, two base-side plates to cover side surfaces of the inner housing, and an engaging hole in the base-side plate. The convex portion of the inner housing engages the engaging hole. The cover includes an upper plate to cover a top of the inner housing, and cover-side plates rising from sides of the upper plate to overlap the base-side plates and cover the engaging hole.

7 Claims, 7 Drawing Sheets

(51) Int. Cl.
*H01R 13/6581* (2011.01)
*H01R 13/6593* (2011.01)

(56) References Cited

U.S. PATENT DOCUMENTS 5,941,725 A 8/1999 Brennan et al.
6,146,205 A * 11/2000 Lai ..... H01R 13/6275 439/607.41
6,168,466 B1 * 1/2001 Chiou ..... H01R 24/64 439/607.02
6,168,476 B1 * 1/2001 Yang ..... H01R 13/506 439/352
6,602,088 B1 * 8/2003 Zhu ..... H01R 13/6593 439/382
7,452,234 B2 * 11/2008 Ma ..... H01R 13/6582 439/382
7,465,194 B1 * 12/2008 Ho ..... H01R 9/032 439/607.01
7,695,318 B1 * 4/2010 Wang ..... H01R 13/65802 439/607.01
9,520,681 B2 * 12/2016 Peng ..... H01R 13/6593
2007/0155243 A1 * 7/2007 Watanabe ..... H01R 13/6582 439/607.41
2009/0280663 A1 * 11/2009 Yuan ..... H01R 4/02 439/79
2010/0068934 A1 * 3/2010 Li ..... H01R 13/627 439/607.55
2011/0065308 A1 * 3/2011 Lu ..... H01B 7/0892 439/449
2013/0040491 A1 2/2013 Wu
2013/0189877 A1 * 7/2013 Lan ..... H01R 13/6593 439/607.27
2015/0303622 A1 * 10/2015 Tao ..... H01R 13/6581 439/607.55
2017/0222356 A1 * 8/2017 Hashimoto ..... H01R 13/14

FOREIGN PATENT DOCUMENTS

JP 2013-125585 6/2013
JP 2013-156566 8/2013

* cited by examiner

SHIELD CONNECTOR AND SHIELDED CABLE WITH CONNECTOR

CROSS REFERENCE TO RELATED APPLICATION

The application claims priority based on Japanese Patent Application No. 2015-229222 filed on Nov. 24, 2015, the entire disclosure of which is incorporated herein.

BACKGROUND

Field of the Invention

The invention relates to a shield connector and a shielded cable with connector.

Description of the Related Art

Conventionally, a shielded cable is utilized in communication between an electrical component (navigation device, ETC (Electronic Toll Collection) device, monitor or the like) installed in a vehicle, such as an automotive vehicle, and an external device (camera or the like) or between electrical components. A shielded cable for communication generally has wires including a communication wire, a shield conductor for collectively covering the wires and a sheath for covering the outer periphery of the shield conductor. The wire includes a conductor and an insulation coating provided on the outer periphery of the conductor.

Normally, a shield connector is attached to an end part of the shielded cable that has had a sheath removed to expose wires from a shield conductor. The shield connector includes an inner housing for holding terminals connected to conductor end parts of the wires and a shield shell for accommodating the inner housing and an end part of the shielded cable. The shield conductor is connected electrically to the shield shell.

Japanese Unexamined Patent Publication No. 2012-18898 discloses a shield connector that includes: a shield shell having a bipartite structure by being vertically divided into two parts, a base on which an inner housing is arranged and a cover to be mounted on the base to cover the inner housing and an end part of a shielded cable. The base has an upwardly open concave cross-sectional shape perpendicular to a longitudinal direction. The base includes a bottom plate and two side plates located on both sides of the bottom plate. On the other hand, the cover includes a flat cover plate for entirely covering the base from above.

End parts of wires of a shielded cable to be connected to a shield connector are exposed from a shield conductor. However, an inner housing and the end part of the shielded cable are accommodated in a shield shell. Thus, the inner housing and the exposed end parts of the wires are covered by the shield shell. At the end part of the shielded cable, electromagnetic noise is shielded by the shield shell. Thus, shielding properties are ensured to suppress the intrusion of electromagnetic noise from outside and the leakage of electromagnetic noise generated from the wires. In terms of enhancing shielding properties in the shield connector, it is desired to maximally prevent the formation of clearances and openings in the shield shell and to cover around the inner housing and the exposed end parts of the wires over the entire circumference by the shield shell.

In the conventional shield connector described in Japanese Unexamined Patent Publication No. 2012-18898, the shield shell is configured by mounting the cover to the base from above. The cover is a flat plate. Thus, gaps are formed between the cover and the side plates of the base in the shield shell and clearances are formed in a circumferential direction of the shield shell. Thus, there is a high possibility that the inner housing and the exposed end parts of the wires cannot be covered around the entire circumference by the shield shell, and it may not be possible to ensure sufficient shielding properties. Particularly, if the shielded cable includes a communication wire for high-speed communication, the communication wire for high-speed communication easily is affected by electromagnetic noise. Communication quality deteriorates if shielding properties in the shield connector are low.

Further, the side plates of the base of the shield connector described in Japanese Unexamined Patent Publication No. 2012-18898 are cut to form engaging projections to fix the inner housing to the base of the shield shell. Thus, these cut parts serve as openings in the shield shell. Therefore, clearances are formed in the circumferential direction of the shield shell, leading to reduced shielding properties.

Accordingly, one of objects of the present disclosure is to provide a shield connector excellent in shielding properties and a shielded cable with connector including this shield connector.

SUMMARY

A shield connector of the present disclosure is to be connected to an end part of a shielded cable. The shielded cable has wires including at least one communication wire and a shield conductor for collectively covering the wires. The shield connector includes an inner housing configured to hold terminals connected to conductor end parts of the wires, and a convex portion projecting from a side surface of the inner housing. The shield connector also includes a shield shell configured to accommodate the inner housing and the end part of the shielded cable. The shield shell includes a cable inserting portion into which the end part of the shielded cable is inserted. The shield shell also includes a base on which the inner housing is arranged and a cover to be fit to the base. The base includes a bottom plate that extends toward the cable inserting portion and that is configured to cover a lower surface of the inner housing. Two base-side plates rise from both sides of the bottom plate to cover both side surfaces of the inner housing. The base-side plates are formed continuously toward the cable inserting portion. An engaging hole is formed in the base-side plate. The convex portion of the inner housing is engaged with the engaging hole, and the cover includes an upper plate configured to cover an upper surface of the inner housing. The upper plate extends toward the cable inserting portion, and two cover-side plates rise from both sides of the upper plate to overlap on outer sides of the base-side plates and to cover the engaging hole. The cover-side plates are formed continuously toward the cable inserting portion.

According to the above-described shield connector, the base and the cover of the shield shell respectively include the base-side plates and the cover-side plates. Additionally, the cover-side plates overlap with the base-side plates to cover the engaging hole of the base-side plate. Further, the base (bottom plate and base-side plates) and the cover (upper plate and cover-side plates) are formed continuously from the inner housing toward the cable inserting portion. Thus, a clearance is unlikely to be formed in a circumferential direction of the shield shell, and the inner housing and the exposed end parts of the wires are covered around the entire circumference by the shield shell. Therefore, the shield connector can effectively suppress the intrusion and leakage of electromagnetic noise and is excellent in shielding properties.

The inner housing can be positioned and fixed to the base by the engagement of the convex portion of the inner housing and the engaging hole of the base-side plate. Thus, the shield connector can be assembled easily.

The base may include a projection projecting from an outer surface of the base-side plate and a fitting hole may be formed in the cover-side plate of the cover. The projection of the base may be fit into the fitting hole. Accordingly, the cover can be positioned and fit to the base by fitting the projection of the base-side plate and the fitting hole of the cover-side plate. Therefore, the shield connector is assembled easily. Further, by providing the base-side plate with the projection and the cover-side plate with the fitting hole, the fit state of the projection and the fitting hole can be confirmed visually from the outside of the shield shell when the base and the cover are fit to assemble the shield shell.

The cable inserting portion of one of the base and the cover may include a barrel projecting toward the shielded cable and including a crimping piece to be crimped to an end part of the shield connector. The other cable inserting portion may include a projecting piece formed to face the barrel and to contact the end part of the shield connector by being pressed by the crimping piece. In this way, a fastening force can be dispersed when the crimping piece is crimped and the shield connector can be connected more firmly to the end part of the shielded cable while excessive deformation of the end part of the shield conductor by crimping can be prevented. Thus, the above-described embodiment ensures sufficient pull-out strength of the shielded cable.

The cover may include a ridge projecting from an inner surface of the cover-side plate and extending in a vertical direction, and a vertical groove may be formed in the side surface of the inner housing. The ridge of the cover may be inserted into the vertical groove. According to this above embodiment, the cover can be positioned with respect to the inner housing and the inner housing and the shield shell (base and cover) can be positioned more accurately by inserting the ridge of the cover-side plate into the vertical groove of the inner housing.

A shielded cable with connector of the present disclosure includes a shielded cable with wires including at least one communication wire and a shield conductor for collectively covering the wires, and the above-described shield connector to be connected to an end part of the shielded cable. According to the above-described shielded cable with connector, the inner housing and the exposed end parts of the wires can be covered around the entire circumference by the shield shell at the end part of the shielded cable. Thus, the above-described shielded cable with connector can effectively suppress the intrusion and leakage of electromagnetic noise in the shield connector and has high shielding properties in the shield connector.

DETAILED DESCRIPTION

Figure 1:
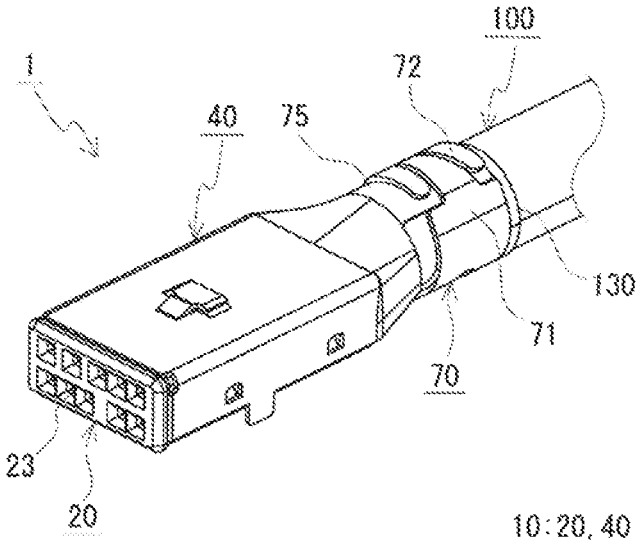
FIG. 1 is a schematic perspective view of a shielded cable with connector of one embodiment viewed from front.

Specific examples of a shield connector and a shielded cable with connector according to an embodiment of the present invention are described with reference to the drawings below. The same components are denoted by the same reference signs in the drawings. Note that the present invention is not limited to these illustrations and is intended to be defined by appended claims and include all modifications within the meaning and scope of the appended claims and equivalents.

<Shielded Cable with Connector>

Figure 2:
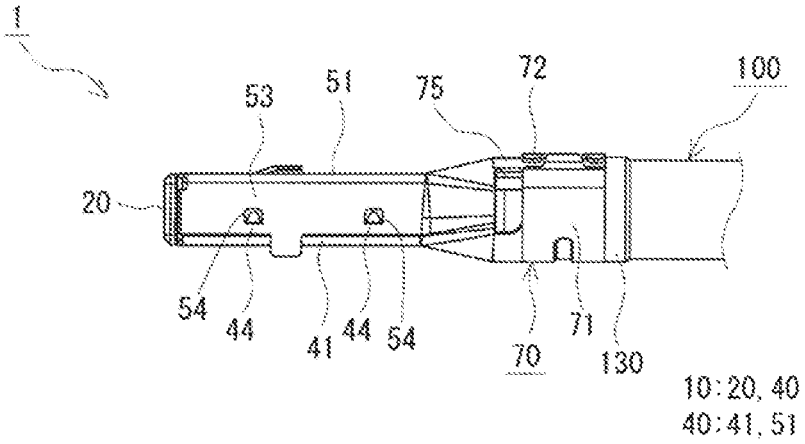
FIG. 2 is a schematic side view of the shielded cable with connector.
Figure 3:
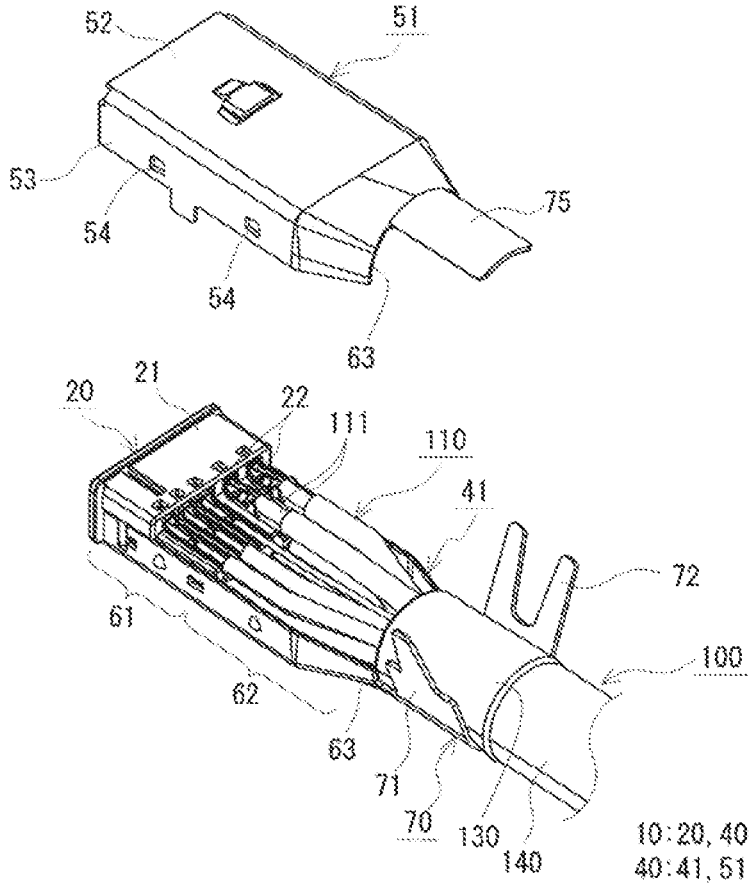
FIG. 3 is a schematic exploded perspective view of the shielded cable with connector viewed from behind.
Figure 4:
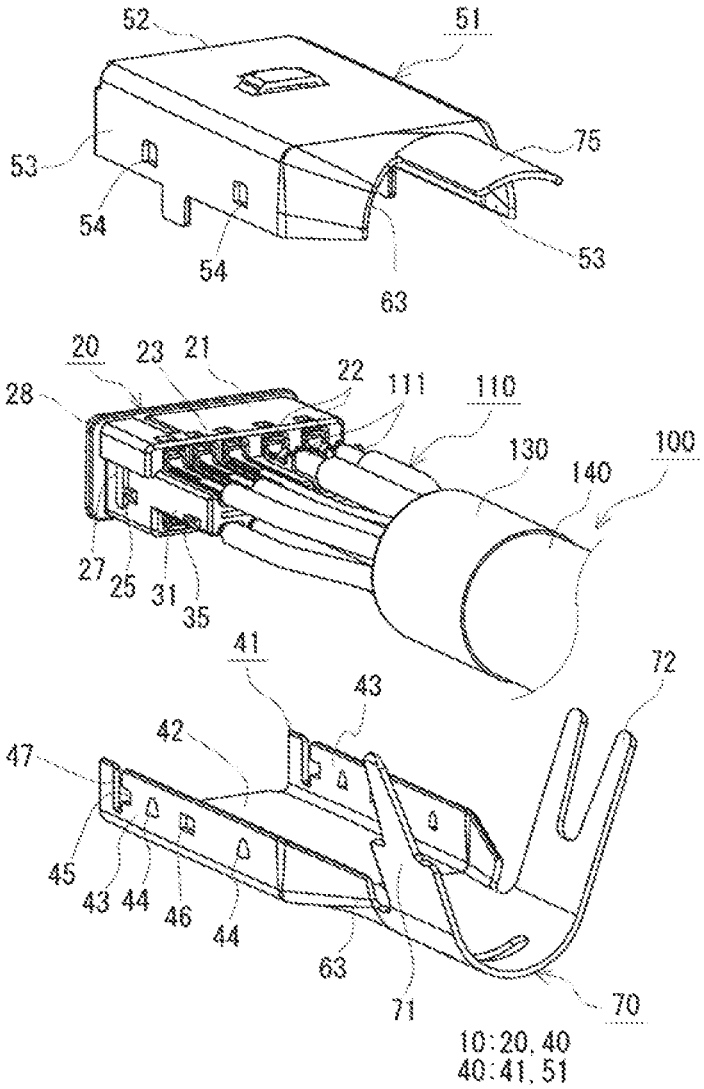
FIG. 4 is another schematic exploded perspective view of the shielded cable with connector viewed from behind.

With reference to FIGS. 1 to 9, an overview of a shield connector and a shielded cable with connector of one embodiment is described. The shielded cable with connector 1 of the embodiment includes a shielded cable 100 and a shield connector 10 to be connected to an end part of the shielded cable 100, as shown in FIGS. 1 and 2. The shield connector 10 includes an inner housing 20 and a shield shell 40, as shown in FIGS. 3 and 4. The shield shell 40 includes a base 41, on which the inner housing 20 is arranged, and a cover 51 to be fit to the base 41. The configuration of the shielded cable 100 is first described and then the configuration of the shield connector 10 is described in detail. In the following description, a side of the shield connector 10 on the side of the inner housing 20 is referred to as a front, a side thereof on the side of the shielded cable 100 is a rear, a side thereof on the side of the base 41 (bottom plate 42) is a lower side and a side thereof on the side of the cover 51 (upper plate 52) is an upper side.

<Shielded Cable>

Figure 5:
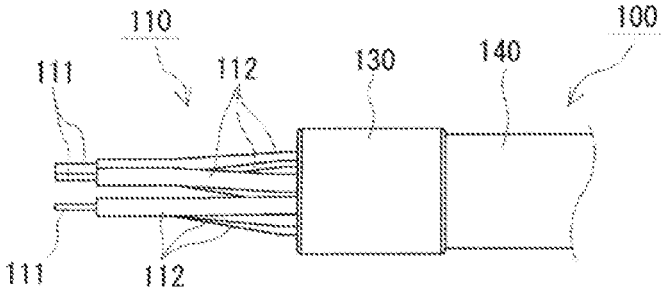
FIG. 5 is a schematic side view of an end part of a shielded cable.

As shown in FIGS. 3 to 5, the shielded cable 100 includes wires 110, a shield conductor 130 for collectively covering the wires 110 and a sheath 140 for covering the outer periphery of the shield conductor 130. The shield conductor 130 is a braided wire made of conductive metal such as copper or aluminum, and the sheath 140 is formed of insulating resin, rubber or the like. At an end part of the shielded cable 100, the sheath 140 is removed, and an end part of the shield conductor 130 is folded onto the sheath 140, as shown in FIG. 5, to expose end parts of the wires 110 from the shield conductor 130. The end parts of the wires 110 are untwisted and branched in parallel as shown in FIG. 4.

Figure 6:
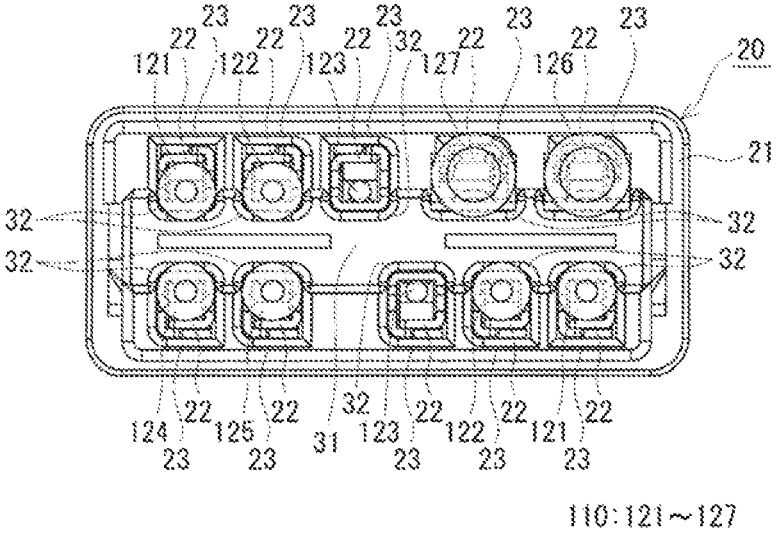
FIG. 6 is a schematic section showing the arrangement of wires in the end part of the shielded cable.

As shown in FIG. 6, the shielded cable 100 includes ten wires 110. Specifically, the shielded cable 100 includes two sets each composed of two communication wires 121, 122 and a drain wire 123 (a total of six wires) for high-speed communication, one set composed of two communication wires 124, 125 (a total of two wires) for low-speed communication, a power supply wire 126 (one wire) and a ground wire 127 (one wire). The communication wires 121, 122 are communication wires of USB (Universal Serial Bus) 3.0 standard (maximum communication speed: 5 Gbps) and constitute a differential pair cable with the drain wire 123. The communication wires 124, 125 are communication wires of USB 2.0 standard (maximum communication speed: 480 Mbps) and constitute a twisted pair cable. Each of the wires 110, excluding the drain wires 123, includes an insulation coating 112 (see FIG. 5) on the outer periphery of a conductor 111. At the end part of the shielded cable 100, end parts of five wires 110 are arranged side by side in each of upper and lower rows, as shown in FIG. 6, and end parts of the conductors 111 are exposed at tips of the wires 110, as shown in FIG. 5. FIG. 6 is a view of the inner housing 20 viewed from behind.

<Shield Connector>

(Inner Housing)

Figure 7:
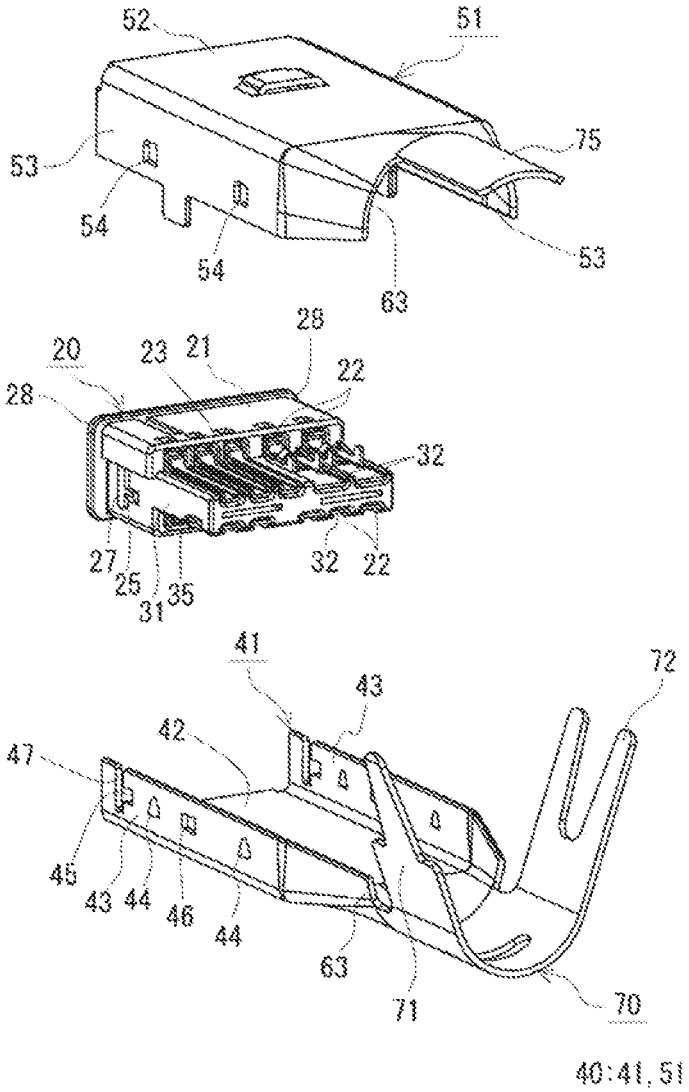
FIG. 7 is a schematic exploded perspective view of a shield connector of the embodiment.

As shown in FIGS. 4 and 6, the inner housing 20 is a member for holding terminals 22 connected to the end parts of the conductors 111 of the wires 110 and is made of insulating resin. As shown in FIG. 7, the inner housing 20 includes a body 21 formed with terminal holes 23 for accommodating the terminals 22 and an arranging portion 31 in which the end parts of the conductors 111 of the wires 110 are arranged. Five terminal holes 23 are formed side by side in each of upper and lower rows in the body 21 of the inner housing 20 (see FIG. 1) and the terminal 22 is inserted and accommodated in each terminal hole 23. The arranging portion 31 is integral to the body 21 and extends rearward from a vertically intermediate position of the body portion 21. As shown in FIGS. 6 and 7, the arranging portion 31 is formed with arrangement grooves 32 for arranging the end parts of the conductors 111.

<Terminals>

The terminal 22 is a female terminal made of conductive metal and includes a rectangular tube to be accommodated into the terminal hole 23 of the body 21. A plate-like part is formed integrally behind the rectangular tube and to be connected electrically to the end part of the conductor 111 (see FIG. 7). This plate-like part is arranged along the arrangement groove 32 of the arranging portion 31. As shown in FIG. 4, the end part of the conductor 111 is placed on the plate-like part of the terminal 22 and electrically connected by soldering. As shown in FIGS. 3 and 4, the inner housing 20 is arranged on the base 41 to be described later with the terminals 22 connected to the end parts of the conductors 111 of the wires 110.

<Convex Portions, Vertical Ribs, Vertical Grooves>

As shown in FIG. 7, the inner housing 20 includes convex portions 25, 35 projecting from the respective side surfaces of the body 21 and the arranging portion 31 (although only left side surfaces are shown in FIG. 7, the same holds for the right side surfaces on an opposite side). The convex portions 25, 35 are provided side by side in a front-rear direction of the inner housing 20 and each of them is tapered toward the bottom. The convex portions 25, 35 are engaged with engaging holes 45, 46 formed in base-side plates 43 to be described later. Further, the inner housing 20 includes vertical ribs 27 projecting from the side surfaces and extending in a vertical direction, and the vertical ribs 27 are integral to the convex portions 25 to be adjacent to the convex portions 25. The vertical ribs 27 are inserted into vertical holes 47 formed in the base-side plates 43 to be described later.

Figure 8:
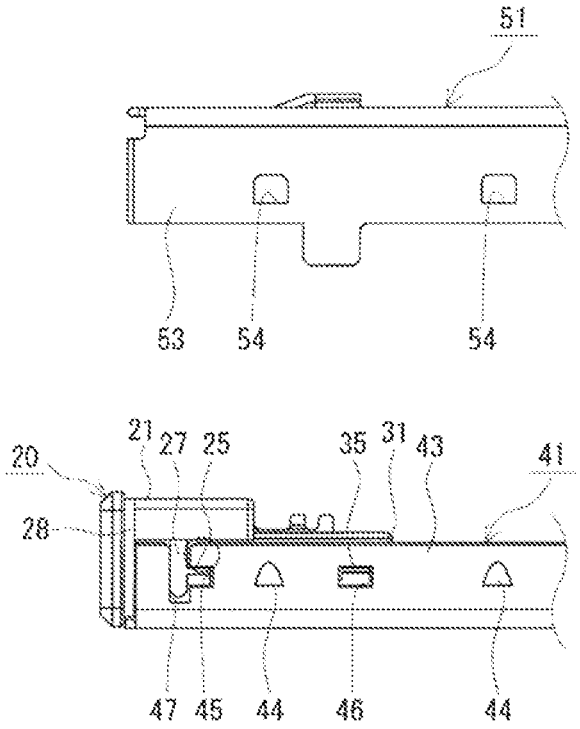
FIG. 8 is a schematic side view partially showing a cover of a shield shell and a base having an inner housing arranged thereon in the shield connector.
Figure 9:
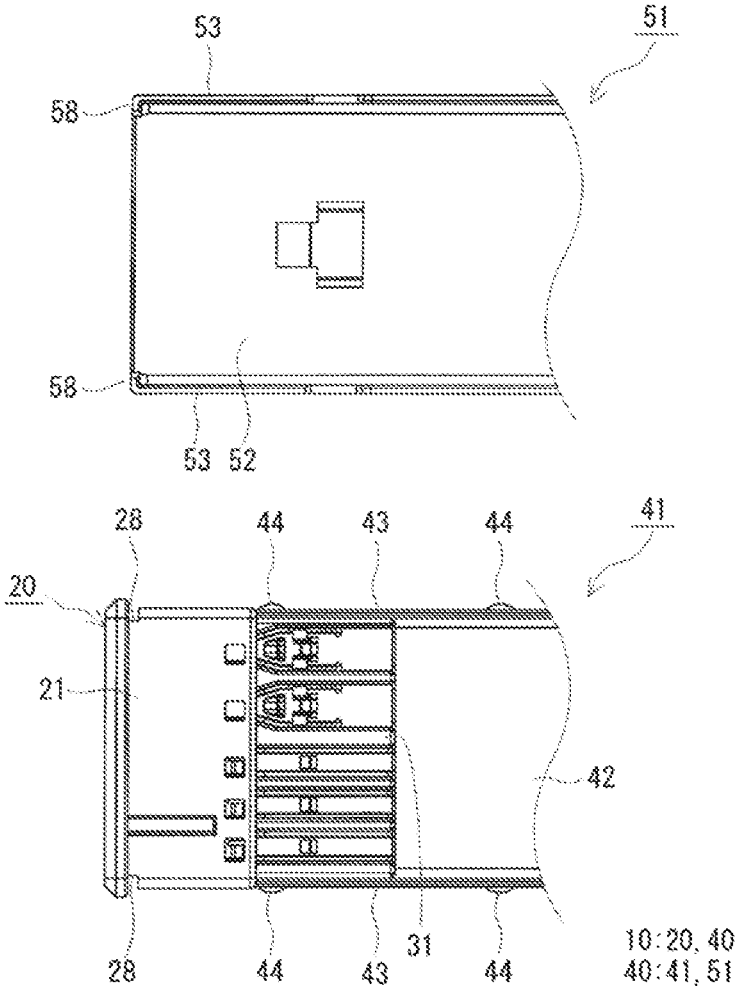
FIG. 9 is a schematic plan view partially showing the cover of the shield shell and the base having the inner housing arranged thereon.

Further, as shown in FIGS. 8 and 9, vertical grooves 28 are formed along the vertical direction in the side surfaces of the inner housing 20. An upper view of FIG. 9 is a schematic plan view of the cover 51 viewed from below, and a lower view is a schematic plan view of the base 41 having the inner housing 20 arranged thereon viewed from above. The vertical grooves 28 are provided in a front part of the inner housing 20 and ridges 58 provided on the base-side plates 43 to be described later are inserted into the vertical grooves 28.

(Shield Shell)

As shown in FIGS. 3 and 4, the shield shell 40 is configured for accommodating the inner housing 20 and the end part of the shielded cable 100 and is made of conductive metal. As shown in FIG. 3, the shield shell 40 includes a housing accommodating portion 61 for accommodating the inner housing 20, a wire accommodating portion 62 for accommodating the exposed end parts of the wires 110 and a cable inserting portion 63 for having the end part of the shielded cable 100 inserted therein in this order from front. The cable inserting portion 63 is formed with an opening shaped to correspond to an outer diameter of the shielded cable 100. The shield shell 40 is composed of the base 41 to be arranged on a lower side of the inner housing 20 and the cover 51 to be arranged on an upper side of the inner housing 20 and fit to cover the base 41 from above.

(Base)

As shown in FIG. 7, the base 41 includes the bottom plate 42 configured to cover the lower surface of the inner housing 20 and extending toward the cable inserting portion 63 and two base-side plates 43 rising from both sides of the bottom plate 42 to cover the both side surfaces of the inner housing 20. The base-side plates 43 are formed continuously toward the cable inserting portion 63. The base 41 is formed by cutting a metallic plate material into a predetermined shape and bending the cut piece.

<Engaging Holes, Vertical Holes>

As shown in FIGS. 7 and 8, the base-side plates 43 of the base 41 are formed with the engaging holes 45, 46 with which the convex portions 25, 35 of the inner housing 20 are engaged. Further, the vertical holes 47 are formed along the vertical direction from the upper end edges of the base-side plates 43 to be adjacent to the engaging holes 45, and the engaging holes 45 and the vertical holes 47 communicate. The vertical ribs 27 of the inner housing 20 are inserted into these vertical holes 47. By fitting the inner housing 20 from above the base 41, the convex portions 25, 35 and the vertical ribs 27 of the inner housing 20 respectively engage the engaging holes 45, 46 and the vertical holes 47 of the base-side plates 43 to fix and position the inner housing 20 to the base 41. The engaging holes 45 and the vertical holes 47 communicate and parts (parts enclosed by dotted line in FIG. 8) of the base-side plates 43 located above the engaging holes 45 are cantilevered. Thus, when the inner housing 20 is fit from above the base 41 and the convex portions 25 are engaged with the engaging holes 45, the above-described parts of the base-side plates 43 easily are opened outward to facilitate the engagement.

<Projections>

Projections 44 project from the outer surfaces of the base-side plates 43, as shown in FIGS. 7 to 9. The projections 44 are fit into fitting holes 54 (see FIGS. 7 and 8) formed in cover-side plates 53 to be described later. These projections 44 are formed by striking and to define a dome shape that bulges down. An interruption is formed between the bottom of the projection 44 and the outer surface, but this interruption is not seen in a planar view of the outer surface of the base-side plate 43 (side surface of the base 41) as shown in FIG. 8. That is, a part where the projection 44 is formed is not open in a direction perpendicular to the outer surface of the base-side plate 43.

(Cover)

As shown in FIG. 7, the cover 51 includes the upper plate 52 configured to cover the upper surface of the inner housing 20 and extending toward the cable inserting portion 63. Two cover-side plates 53 rise from both sides of the upper plate 52 to overlap on outer sides of the base-side plates 43. The cover-side plates 53 cover the engaging holes 45, 46 and the vertical holes 47 of the base-side plates 43 by overlapping on the outer sides of the base-side plates 43 (see FIG. 2). The cover-side plates 53 are formed continuously toward the cable inserting portion 63. Similar to the base 41, the cover 51 is formed by cutting a metallic plate material into a predetermined shape and bending the cut piece. As shown in FIG. 3, the cover 51 is mounted from above the base 41 with the inner housing 20 and the end part of the shielded cable 100 (wires 110) arranged on the base 41.

<Fitting Holes>

As shown in FIGS. 7 and 8, the cover-side plates 53 of the cover 51 are formed with the fitting holes 54 into which the projections 44 of the base-side plates 43 are fit. When the cover 51 is fit to the base 41 (see FIG. 2), the projections 44 of the base-side plates 43 and the fitting holes 54 of the cover-side plates 53 engage so that the cover 51 is positioned and fixed to the base 41.

<Ridges>

Further, as shown in FIG. 9, the cover 51 includes the vertically extending ridges 58 projecting from the inner surfaces of the cover-side plates 53. The ridges 58 are formed by bending the tips of the cover-side plates 53 inward. The cover 51 is positioned with respect to the inner housing 20 by inserting these ridges 58 into the vertical grooves 28 formed in the inner housing 20.

<Barrel Portion, Projecting Pieces>

As shown in FIG. 3, the end part of the shielded cable 100 is inserted such that the folded end part of the shield conductor 130 is accommodated partly in the shield shell 40 and the remaining part is exposed from the cable inserting portion 63. As shown in FIGS. 3 and 4, the cable inserting portion 63 on the side of the base 41 is formed integrally with a barrel 70 projecting rearward. The barrel 70 is U-shaped and includes two crimping pieces 71, 72 extending from both ends. By inserting the end part of the shield conductor 130 from above the barrel 70 and caulking the crimping pieces 71, 72, the crimping pieces 71, 72 are crimped to the end part of the shield conductor 130 (see FIG. 1). The barrel 70 is formed into a hollow cylindrical shape with the crimping pieces 71, 72 meshed with each other when the crimping pieces 71, 72 are caulked and crimped to the end part of the shield conductor 130. Specifically, the crimping piece 71 includes a tapered projecting piece and the crimping piece 72 includes a forked projecting piece having a V-shaped cut into which the projecting piece of the crimping piece 71 is fit.

Further, as shown in FIG. 3, the cable inserting portion 63 on the side of the cover 51 is integral with a projecting piece 75 projecting rearward to face the barrel 70. The projecting piece 75 is formed into an arcuate shape to extend along the outer peripheral surface of the shielded cable 100. The projecting piece 75 is located inside the crimping pieces 71, 72 to be pressed and to contact the end part of the shield conductor 130 when the barrel 70 is crimped by caulking the crimping pieces 71, 72 (see FIG. 1). By crimping the barrel 70 to the end part of the shield conductor 130, the barrel 70 (crimping pieces 71, 72) and the projecting piece 75 contact the end part of the shield conductor 130 for electrically connecting the shield shell 40 and the shield conductor 130.

<Functions and Effects>

The shield connector 10 and the shielded cable with connector 1 of the embodiment exhibit the following effects.

The base 41 and the cover 51 constituting the shield shell 40 respectively include the base-side plates 43 and the cover-side plates 53, and the cover-side plates 53 overlap with the base-side plates 43 to cover the engaging holes 45, 46 and the vertical holes 47 of the base-side plates 43. Further, the base 41 (bottom plate 42 and base-side plates 43) and the cover 51 (upper plate 52 and cover-side plates 53) respectively are formed continuously from the housing accommodating portion 61 to the cable inserting portion 63. Thus, in the shield connector 10, a clearance is unlikely to be formed in a circumferential direction of the shield shell 40 and the inner housing 20 and the exposed end parts of the wires 110 are covered around over the entire circumference by the shield shell 40. Therefore, the shield connector 10 can effectively suppress the intrusion and leakage of electromagnetic noise and is excellent in shielding properties. Further, since the shielded cable with connector 1 includes the shield connector 10, shielding properties in the shield connector 10 are high and communication quality can be improved. Particularly, an improvement of communication quality can be expected in the case of application to the shielded cable including the communication wires 121, 122 for high-speed communication.

The inner housing 20 can be positioned and fixed to the base 41 by the engagement of the convex portions 25, 35 of the inner housing 20 and the engaging holes 45, 46 of the base-side plates 43. Thus, the shield connector 10 is assembled easily. Further, vertical movements of the inner housing 20 with respect to the base 41 and the inclination of the inner housing 20 can be suppressed by the engagement of the convex portions 25, 35 and the engaging holes 45, 46. Furthermore, movements of the inner housing 20 in the front-rear direction with respect to the base 41 and the inclination of the inner housing 20 can be suppressed effectively by inserting the vertical ribs 27 of the inner housing 20 into the vertical holes 47 of the base-side plates 43. By restricting movements of the inner housing 20 with respect to the shield shell 40, impedance between the inner housing 20 and the shield shell 40 is unlikely to change. Therefore, deterioration of communication quality due to an impedance mismatch in the shield connector 10 can be suppressed.

The cover 51 can be positioned and fixed to the base 41 by fitting the projections 44 of the base-side plates 43 and the fitting holes 54 of the cover-side plates 53. Thus, the shield connector 10 is assembled easily. By forming the projections 44 by striking, the parts where the projections 44 are formed are not open in the direction perpendicular to the outer surfaces of the base-side plates 43 and the formation of clearances in the circumferential direction of the shield shell 40 can be prevented. Further, by providing the base-side plates 43 with the projections 44 and the cover-side plates 53 with the fitting holes 54, the fit state of the projections 44 and the fitting holes 54 can be confirmed visually from the outside of the shield shell 40 when the base 41 and the cover 51 are fit to assemble the shield shell 40 to achieve further assembling efficiencies.

The cover 51 can be positioned with respect to the inner housing 20 by inserting the ridges 58 of the cover-side plates 53 into the vertical grooves 28 of the inner housing 20. In this way, the inner housing 20 and the shield shell 40 (base 41 and cover 51) are positioned more accurately.

The shield shell 40 and the shield conductor 130 can be electrically connected by crimping the crimping pieces 71, 72 of the barrel 70 to the end part of the shield conductor 130. Further, the shield shell 40 (shield connector 10) can be connected firmly to the end part of the shielded cable 100 and movements of the shield shell 40 in the front-rear direction can be restricted. Furthermore, by including the projecting piece 75 facing the barrel 70, a fastening force can be dispersed when the crimping pieces 71, 72 are crimped, and the shield connector 10 can be connected more firmly while excessive deformation of the end part of the shield conductor 130 by crimping can be prevented. Thus, sufficient pull-out strength of the shielded cable 100 can be ensured.

Application of Embodiment of Present Invention

The shield conductor and the shielded cable with connector according to the embodiment of the present invention are suitably applicable to shielded cables for high-speed communication.

List of Reference Signs

| | | | |
|---|---|---|---|
| 1 | shielded cable with connector | | |
| 10 | shield conductor | | |
| 20 | inner housing | | |
| 21 | body | | |
| 22 | terminal | 23 | terminal hole |
| 25 | convex portion | 27 | vertical rib 28 vertical groove |
| 31 | arranging portion | 32 | arrangement groove |
| 35 | convex portion | | |
| 40 | shield shell | | |
| 41 | base | | |
| 42 | bottom plate | 43 | base-side plate |
| 44 | projection | | |
| 45, 46 | engaging hole | 47 | vertical hole |
| 51 | cover | | |
| 52 | upper plate | 53 | cover-side plate |
| 54 | fitting hole | 58 | ridge |
| 61 | housing accommodating portion | 62 | wire accommodating portion |
| 63 | cable inserting portion | | |
| 70 | barrel | 71, 72 | crimping piece |
| 75 | projecting piece | | |
| 100 | shielded cable | | |
| 110 | wire | | |
| 11 | conductor | 112 | insulation coating |
| 121, 122 | communication wire | 123 | drain wire |
| 124, 125 | power supply wire | 127 | ground wire |
| 130 | shield conductor | 140 | sheath |

The invention claimed is:

1. A shield connector to be connected to an end part of a shielded cable with wires including at least one communication wire and a shield conductor for collectively covering around the wires, comprising:

an inner housing configured to hold terminals to be connected to conductor end parts of the wires, the inner housing having opposed first and second side surfaces, first and second convex portions projecting respectively from the first and second side surfaces and first and second vertical ribs projecting respectively from the first and second side surfaces at positions adjacent to the respective convex portions, the first and second convex portions and the first and second vertical ribs, respectively, being formed integrally with each other;

a shield shell configured to accommodate the inner housing and the end part of the shielded cable, the shield shell including a base and a cable inserting portion into which the end part of the shielded cable is inserted, the base extending from the cable insertion portion and including a bottom plate configured to cover a lower surface of the inner housing, first and second base-side plate portions projecting from opposite sides of the bottom plate and extending from the cable insertion portion to cover the first and second side surfaces of the inner housing, each of the first and second base-side plate portions formed with an engaging hole and a vertical hole at positions corresponding to the first and second convex portions and the first and second vertical ribs of the inner housing and configured to receive the first and second convex portions and the first and second vertical ribs when the inner housing is accommodated in the base plate; and a shield shell cover having an upper plate configured to cover an upper surface of the inner housing and two cover-side plates rising from opposite sides of the upper plate to overlap on outer sides of the base-side plates and cover the engaging hole.

2. The shield connector of claim 1, wherein:

the base includes a projection projecting from an outer surface of the base-side plate; and a fitting hole is formed in the cover-side plate of the cover, the projection of the base being fit into the fitting hole.

3. The shield connector of claim 2, wherein the cable inserting portion of one of the base and the cover includes a barrel projecting toward the shielded cable and including a crimping piece to be crimped to an end part of the shield conductor, and the other cable inserting portion includes a projecting piece formed to face the barrel and to contact the end part of the shield conductor by being pressed by the crimping piece.

4. The shield connector of claim 3, wherein:

the cover includes a ridge projecting from an inner surface of the cover-side plate and extending in a vertical direction; and a vertical groove is formed in the side surface of the inner housing, the ridge of the cover being inserted into the vertical groove.

5. A shielded cable with connector, comprising:

a shielded cable with wires including at least one communication wire and a shield conductor for collectively covering around the wires; and the shield connector of claim 1 connected to an end part of the shielded cable.

6. The shield connector of claim 1, wherein the cable inserting portion of one of the base and the cover includes a barrel projecting toward the shielded cable and including a crimping piece to be crimped to an end part of the shield conductor, and the other cable inserting portion includes a projecting piece formed to face the barrel and to contact the end part of the shield conductor by being pressed by the crimping piece.

7. The shield connector of claim 1, wherein:

the cover includes a ridge projecting from an inner surface of the cover-side plate and extending in a vertical direction; and a vertical groove is formed in the side surface of the inner housing, the ridge of the cover being inserted into the vertical groove.

* * * * *